US008360350B2

(12) United States Patent
Mepham et al.

(10) Patent No.: US 8,360,350 B2
(45) Date of Patent: Jan. 29, 2013

(54) DISCHARGE END LINER

(75) Inventors: Robert Mepham, Fergus (CA); David J. Page, Elora (CA); Pramod Kumar, Waterloo, CA (US)

(73) Assignee: Polycorp Ltd., Elora, ON (CA)

( * ) Notice: Subject to any disclaimer, the term of this patent is extended or adjusted under 35 U.S.C. 154(b) by 198 days.

(21) Appl. No.: 12/994,248

(22) PCT Filed: May 26, 2009

(86) PCT No.: PCT/CA2009/000725

§ 371 (c)(1),
(2), (4) Date: Nov. 23, 2010

(87) PCT Pub. No.: WO2009/143615

PCT Pub. Date: Dec. 3, 2009

(65) Prior Publication Data

US 2011/0068207 A1 Mar. 24, 2011

Related U.S. Application Data

(60) Provisional application No. 61/056,222, filed on May 27, 2008.

(51) Int. Cl.
*B02C 17/04* (2006.01)

(52) U.S. Cl. ..... 241/70; 241/299

(58) Field of Classification Search ..... 241/70, 241/299

See application file for complete search history.

(56) References Cited

U.S. PATENT DOCUMENTS

| | | | |
|---|---|---|---|
| 3,739,993 | A | 6/1973 | Nelson et al. |
| 3,785,577 | A | 1/1974 | Carlsmith et al. |
| 3,806,045 | A | 4/1974 | Jenness |
| 3,987,970 | A | 10/1976 | Burkett |
| 4,049,206 | A | 9/1977 | König et al. |
| 4,312,749 | A | 1/1982 | Bingham |
| 4,365,763 | A | 12/1982 | Guerguerian |
| 4,441,659 | A | 4/1984 | Marklund |
| 4,533,054 | A | 8/1985 | Sommer, Jr. et al. |
| 4,542,856 | A | 9/1985 | Adolph |
| 4,646,980 | A | 3/1987 | Player et al. |
| 4,836,457 | A | 6/1989 | Greiner |
| 4,982,904 | A | 1/1991 | Greiner |
| 5,361,997 | A | 11/1994 | Burkes |
| 5,381,971 | A | 1/1995 | Rehmer |
| 5,598,981 | A | 2/1997 | Hellmich |
| 5,722,607 | A | 3/1998 | Hellmich |
| 6,663,030 | B2 | 12/2003 | Washburn et al. |
| 7,204,636 | B2 | 4/2007 | Didion |
| 2005/0152217 | A1 | 7/2005 | O'Hara |
| 2006/0283993 | A1 | 12/2006 | Latchireddi |

FOREIGN PATENT DOCUMENTS

| | | |
|---|---|---|
| WO | WO9801226 | 1/1998 |

*Primary Examiner* — Mark Rosenbaum

(57) ABSTRACT

A discharge end liner attachable to a discharge end wall in a grinding mill. The discharge end liner includes a number of pulp lifter elements mountable on the discharge end wall for at least partially defining a number of chambers rotatable in the predetermined direction respectively between a submerged condition and a raised condition. The discharge end liner also includes one or more grate subassemblies positionable on the pulp lifter elements, for at least partially screening the slurry. At least a part of each grate subassembly is located by an outer portion of the pulp lifter element in a predetermined position relative to the discharge end wall. An inner portion of each pulp lifter element defines an obtuse angle between the inner portion and the outer portion, for permitting the retained portion of the slurry to evacuate from each chamber respectively while each chamber is in the raised condition.

11 Claims, 13 Drawing Sheets

DISCHARGE END LINER

FIELD OF THE INVENTION

This invention is related to a discharge end liner attachable to a discharge end wall in a grinding mill.

BACKGROUND OF THE INVENTION

Grinding mills for reducing the size of particles of a material to a predetermined maximum particle size are known. Typically, a charge (e.g., ore and water) is added into the grinding mill at an input end of a shell or mill of the grinding mill. The mill is rotated. Typically, the mill includes shell lifter bars positioned lengthwise on the mill, to carry a portion of the charge upwardly as the mill rotates. The portion which is carried upwardly is allowed to fall onto the balance of the charge, thereby providing a tumbling effect, to grind or comminute the material to the predetermined maximum particle size or less. After the particles are reduced to the predetermined maximum particle size or less, such particles are discharged from the grinding mill at a discharge end thereof, e.g., via a centrally-mounted discharge trunnion, as the mill rotates.

Certain aspects of the prior art discharge end liners are illustrated in FIGS. 1 and 2. (As will be described, the remainder of the drawings illustrate the present invention.) A schematic illustration of a discharge end liner 20 of the prior art is provided in FIG. 1. As can be seen in FIG. 1, the typical grinding mill includes a number of pulp lifters 22 which are positioned on a discharge end wall (or mill head) 41 in a pattern around an inner opening 24 in the discharge end wall, and which define chambers 26 therebetween. (It will be understood that various features of the prior art discharge end liner have been omitted from FIG. 1 for purposes of illustration.) As is well known in the art, the discharge end wall is rotatably mounted on a discharge end trunnion, and the inner opening is located around the discharge end trunnion and coaxial therewith. Often, the head is positioned at an angle (e.g., 15° relative to a central axis (not shown in FIGS. 1 and 2) about which the shell and the discharge end wall rotate, i.e., the head may form a truncated cone. As is known, the charge typically is positioned in a lower part of the shell only up to a limited height, i.e., the region generally designated as "X" in FIG. 1. In FIG. 1, the direction of rotation is indicated by arrow "A".

The charge moves gradually to the discharge end as the mill rotates. As is well known in the art, the mill may be autogenous or semi-autogenous, i.e., the charge may include other materials (e.g., balls) for improving the grinding action.

Also, as the mill rotates, each chamber 26 is moved between a submerged condition (in which each chamber is at least partially submerged in the charge respectively) and a raised condition (in which each chamber is raised above the charge respectively).

In the prior art, the pulp lifters 22 support one or more grate subassemblies 42 (FIG. 2) which are spaced apart from the discharge end wall, to partially define the chamber 26. Each grate subassembly 42 includes one or more grates, and typically also includes one or more blind plates. Each grate (or grate plate) has holes in it sized to allow particles of the maximum particle predetermined size or less to pass therethrough when the particular chamber is in the portion of its arc in which the charge engages the grate, i.e., when the chamber is in the region identified as "X" in FIG. 1. Accordingly, because of screening by each grate, only relatively fine particles in a slurry (as well as liquid) are allowed into each chamber 26.

For example, as can be seen in FIG. 1, slurry flows into a particular chamber when the chamber is between approximately the 8 o'clock and the 4 o'clock positions (i.e., when the chamber is in the submerged condition). Also, slurry flows out of each chamber and into the inner opening under the influence of gravity when each chamber is approximately between the 3 o'clock and the 9 o'clock positions (i.e., when each chamber is in the raised condition).

Each chamber 26 has an exit port 28 at an inner end 30 thereof, through which the slurry is discharged from the chamber. Preferably, upon discharge, the slurry is directed by an outer wall of a discharge cone 31 (FIG. 2) through the discharge trunnion (not shown), to exit the grinding mill.

The prior art pulp lifters have some disadvantages. In the prior art, significant discharge typically does not actually begin until the chamber is at approximately the 12 o'clock position, and (as indicated above) discharge must be completed by the time the chamber has reached the 9 o'clock position. In the event that the evacuation of the slurry from a chamber has not been completed (or substantially completed) when the chamber reaches the 9 o'clock position, slurry remains in the chamber, thereby effectively reducing the capacity of the grinding mill. In the prior art, failure to completely discharge (or substantially completely discharge) can result in a substantial proportion of the chamber being occupied by undischarged slurry, in turn resulting in substantially increased operating costs.

Typically, the mill is rotated at a relatively high speed, to achieve optimal throughput. For example, a typical mill with an internal diameter of about 32 feet (approximately 9.8 meters) may rotate at about 10 revolutions per minute. Although decreasing the rotation speed would facilitate discharge from each chamber, such decrease is understood to be counterproductive, as any such decrease would also decrease throughput, as is well known in the art.

One attempt to address the problem of failing to substantially evacuate the chamber is shown in FIG. 1. In FIG. 1, adjacent pulp lifters (identified in FIG. 1 with reference numerals 32, 34, 36) have different lengths, i.e., they are terminated at different distances from the inner opening 24. The disadvantage of this approach is that the flow of slurry out of one chamber may obstruct the flow of slurry out of an adjacent (lower) chamber. For example, in the position shown in FIG. 1, flow of slurry out of chamber "Y" (between pulp lifters 32 and 34), schematically represented by arrow "B", is obstructed to an extent by slurry flowing out of chamber "Z", represented by arrow "C".

A cross-section of a typical pulp lifter assembly 22 of the prior art is provided in FIG. 2. In FIG. 2, the pulp lifter assembly 22 (and the chamber 26 partially defined thereby) is shown in the raised condition. The prior art pulp lifter assembly 22 includes, for example, one or more outer lifter segments 38, and one or more inner lifter segments 40, which are mounted onto a discharge end wall 41, which is attached to an outer wall 39 of a shell (or mill) 52. The grate subassembly 42 is positioned on the lifter segments 38, 40. As is well known in the art, the grate subassembly 42 typically includes one or more grate plates 44 (i.e., with appropriately-sized holes 45 therein, as described above) and a blind plate 46. (It will be understood that the holes 45 are represented in FIG. 2 much larger than is appropriate, to simplify the illustration. As is well known in the art, the holes 45 are generally relatively small.) The blind plate 46 does not have holes in it, so that it assists in directing slurry toward the inner opening, when the chamber is in the raised condition. An outer wall 48 of the central cone 31 is also shown in FIG. 2. As can be seen in FIG. 2, when the chamber 26 in the raised condition 26, the slurry therein flows under the influence of gravity in the direction generally indicated by arrow "D", to exit the chamber 26, subsequently to be directed by the outer wall 48 (i.e., in the direction indicated by arrow "E") to the inner opening 24, and out of the grinding mill.

In practice, the slurry exiting the chamber as indicated by arrow "D" in FIG. 2 is only a retained portion of the total volume of slurry (the "inflow volume") which had entered the chamber while the chamber was in the submerged condition. Such retained portion typically represents a major part of the inflow volume of slurry. As is known, a backflow portion of the inflow volume backflows into the shell (i.e., into the charge) while each chamber is being raised out of the submerged condition toward approximately the 12 o'clock position. In general, backflow tends to be minimal between the 12 o'clock position and the 9 o'clock position. The retained portion is the balance of the inflow volume remaining in the chamber once the backflow volume is taken into account.

SUMMARY OF THE INVENTION

For the reasons set out above, there is therefore a need for a discharge end liner which addresses or mitigates one or more of the disadvantages of the prior art.

In its broad aspect, the invention provides a discharge end liner attachable to a discharge end wall in a grinding mill. The grinding mill includes a hollow shell connected to the discharge end wall and rotatable in a predetermined direction about a central axis thereof to produce a slurry including liquid and particles from a charge in the shell. The discharge end wall extends between an outer edge thereof connected to the shell and an inner edge at least partially defining an inner opening substantially coaxial with the central axis. The discharge end liner includes a number of pulp lifter elements mountable on the discharge end wall for at least partially defining a number of chambers rotatable in the predetermined direction between a submerged condition, in which each chamber is at least partially submerged in the charge to permit the slurry to enter each chamber respectively, and a raised condition, in which at least a retained portion of the slurry in each chamber is drainable into the inner opening. The discharge end liner also includes at least one or more grate subassemblies positionable on the pulp lifter elements, for at least partially screening the slurry as it flows into each chamber respectively while each chamber is in the submerged condition. Each pulp lifter element includes an outer portion extending from the outer edge of the discharge end wall toward the inner edge, and an inner portion extending from the inner edge toward the outer edge, when each pulp lifter element is attached to the discharge end wall. At least part of the outer portion is formed to locate at least a part of each grate subassembly in a predetermined position relative to the discharge end wall. The inner portion is formed to define an obtuse angle between the outer and inner portions of each pulp lifter element to permit the retained portion of the slurry in each chamber to evacuate therefrom respectively while each chamber is in the raised condition.

In one aspect, the predetermined position of the part of the grate subassembly is substantially parallel to the discharge end wall.

BRIEF DESCRIPTION OF THE DRAWINGS

The invention will be better understood with reference to the drawings, in which.

DETAILED DESCRIPTION

Figure 1:
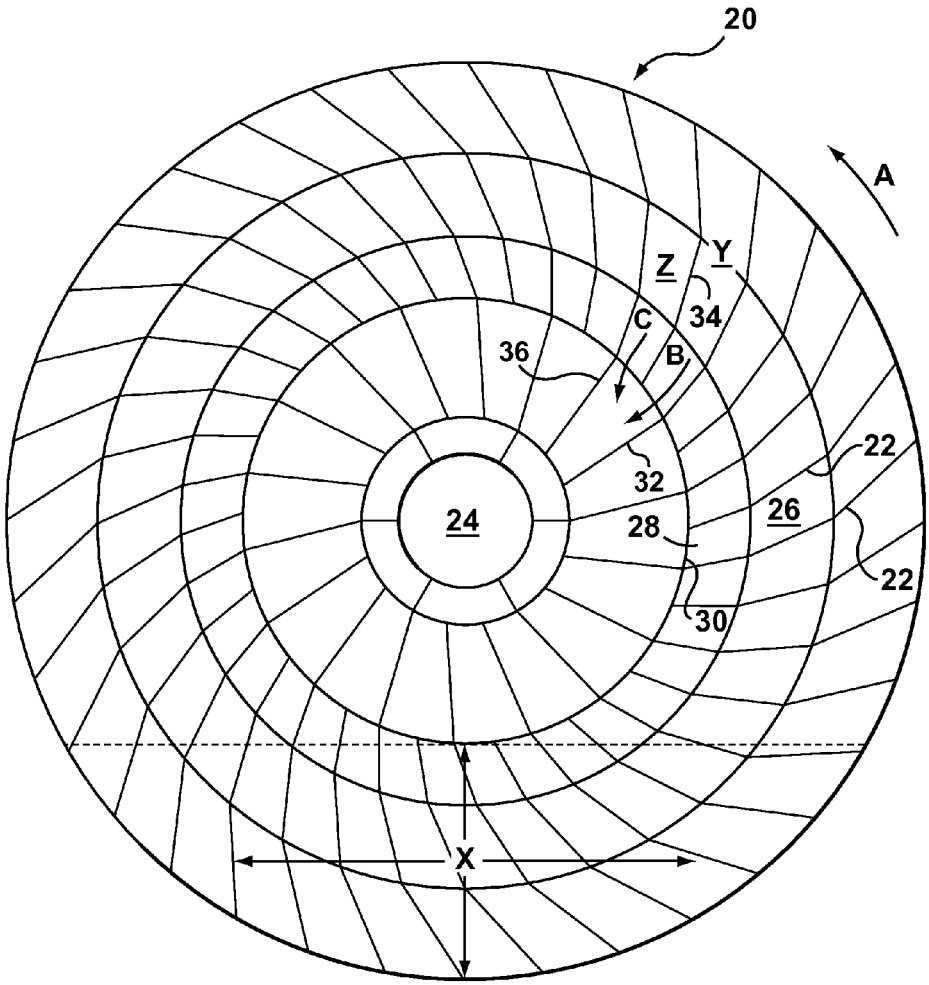
FIG. 1 (PRIOR ART)
FIG. 1 (also described previously) is a schematic illustration of a prior art arrangement of pulp lifters at a discharge end in a grinding mill.
Figure 2:
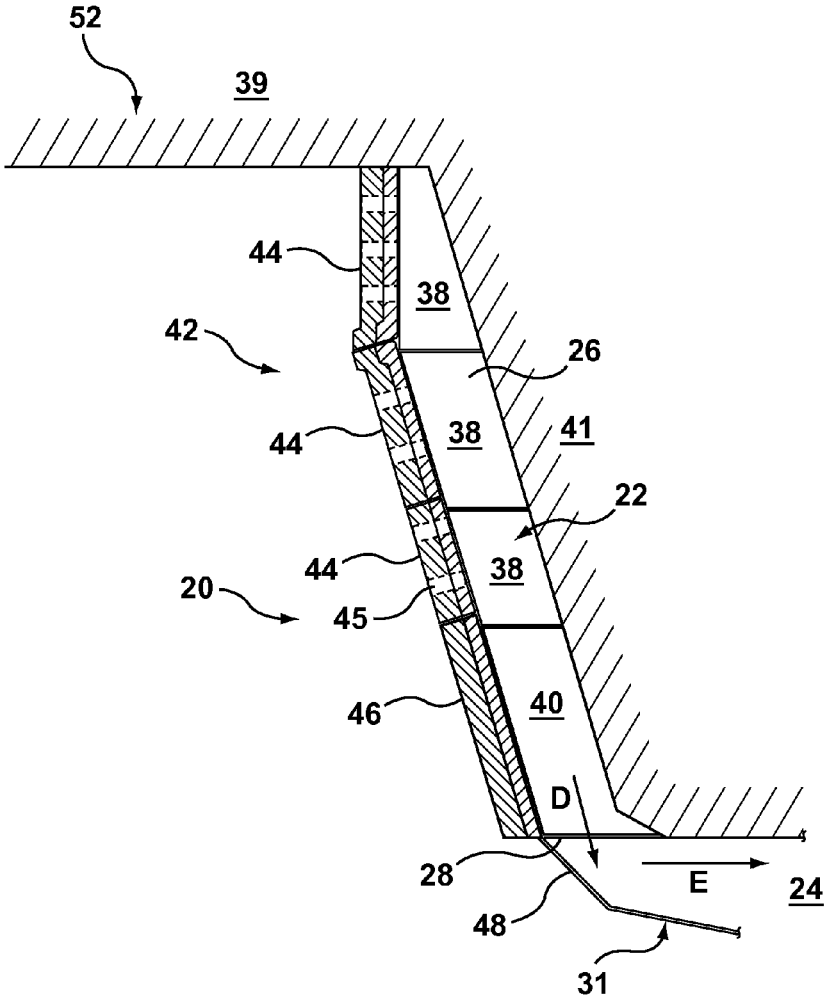
FIG. 2 (PRIOR ART)
FIG. 2 (also described previously) is an elevation view of a pulp lifter assembly of the prior art, drawn at a larger scale.
Figure 3A:
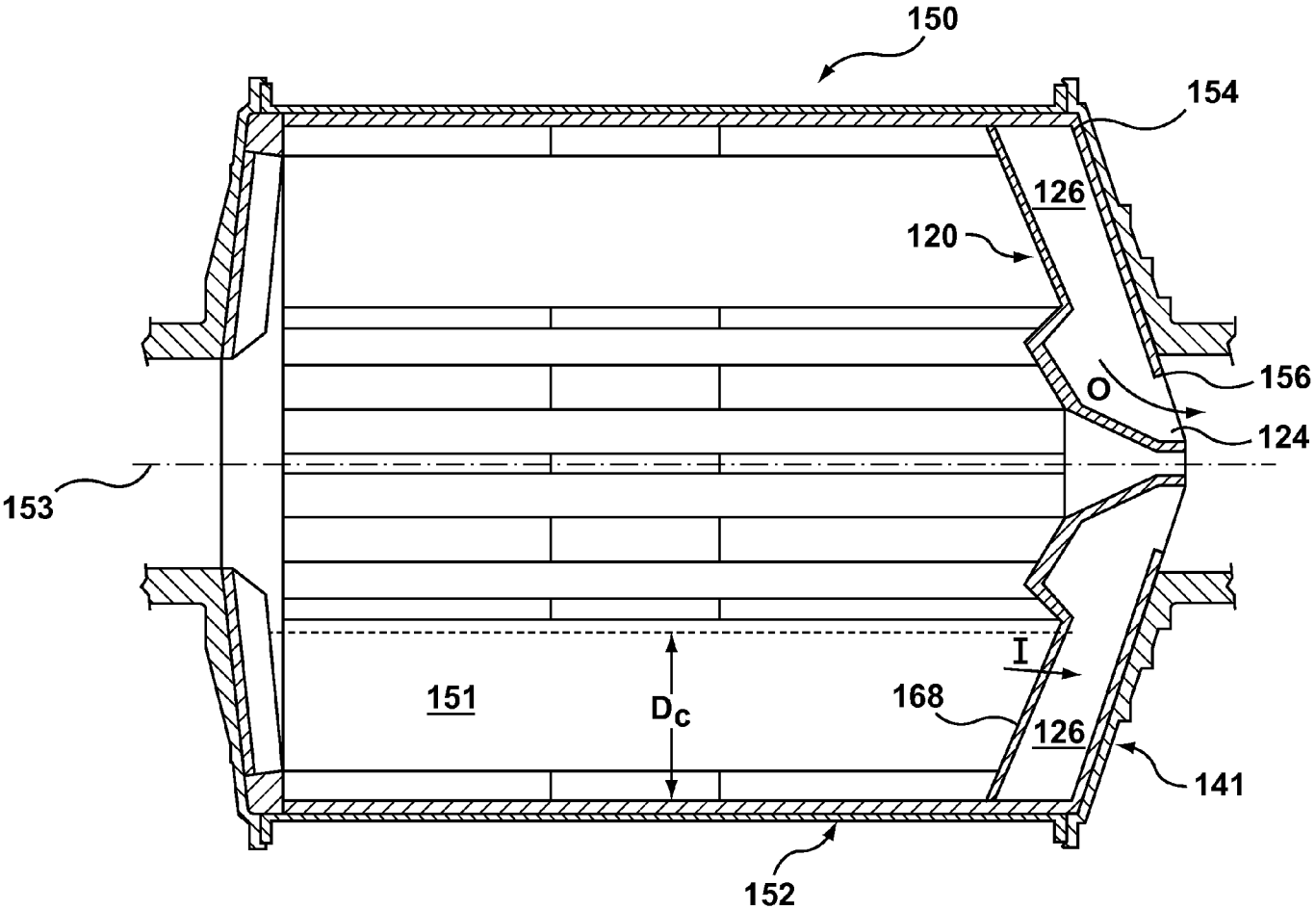
FIG. 3A is a longitudinal cross-section of an embodiment of a grinding mill of the invention, drawn at a smaller scale.

Reference is first made to FIGS. 3A-10 to describe an embodiment of a discharge end liner assembly in accordance with the invention indicated generally by the numeral 120. The discharge end liner 120 is attachable to a discharge end wall 141 in a grinding mill 150 (FIG. 3A). The grinding mill 150 includes a hollow shell 152 connected to the discharge end wall 141 and rotatable in a predetermined direction about a central axis 153 thereof to produce a slurry including liquid and particles from a charge 151 in the shell 152 (FIG. 3A). The discharge end wall 141 extends between an outer edge 154 thereof connected to the shell 152 and an inner edge 156 at least partially defining an inner opening 124 substantially coaxial with the central axis 153. In one embodiment, the discharge end liner 120 includes a number of pulp lifter elements 158 mountable on the discharge end wall 141 for at least partially defining a number of chambers 126 rotatable in the predetermined direction between a submerged condition, in which each chamber 126 is as least partially submerged respectively in the charge to permit the slurry to enter each chamber 126 (FIG. 3B), and a raised condition, in which at least a portion of the slurry in each chamber 126 is drainable into the inner opening 124 (FIG. 3C). As can be seen in FIGS. 3B and 3C, the discharge end liner 120 preferably also includes one or more grate subassemblies 142 positionable on the pulp lifter elements 158, for at least partially screening the slurry as it flows into each chamber 126 respectively while each chamber 126 is in the submerged condition. Preferably, each pulp lifter element 158 includes an outer portion 162 extending from the outer edge 154 of the discharge end wall 141 toward the inner edge 156, and an inner portion 164 extending from the inner edge 156 toward the outer edge 154, when each pulp lifter element 158 is attached to the discharge end wall 141. In one embodiment, at least a part 166 of the outer portion 162 preferably is formed to locate at least a part 168 of the grate subassembly 142 in a predetermined position relative to the discharge end wall 141, as will be described. In one embodiment, the inner portion 164 is formed to define an obtuse angle θ between the outer and inner portions 162, 164 of the pulp lifter element 158, to permit the retained portion of the slurry in each chamber 126 respectively to evacuate therefrom while each chamber 126 is in the raised condition.

Figure 3B:
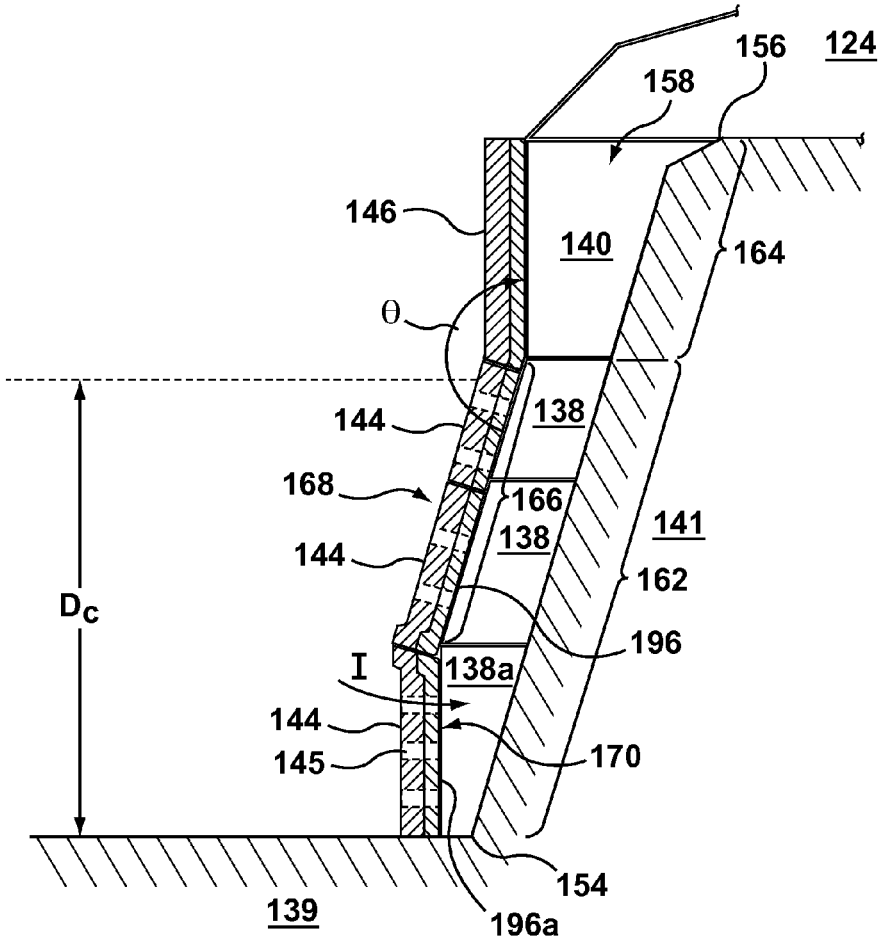
FIG. 3B is an elevation view of an embodiment of a pulp lifter assembly of the invention drawn at a larger scale, shown in a submerged condition.

The charge 151 has a depth "$D_c$" which, in general, is not more than approximately one-third of the inner diameter of the shell (FIG. 3A). As can be seen in FIGS. 3A and 3B, for example, slurry flows into each chamber 126 when each chamber 126 is in the submerged condition respectively, as indicated by arrows "I" in FIGS. 3A and 3B. The retained portion of the slurry flows out of each chamber 126 when each chamber 126 is in the raised condition, represented by arrows "O" in FIGS. 3A and 3C.

It will be understood that each chamber 126 and the pulp lifter elements 158 partially defining each such chamber respectively rotate between the submerged condition and the raised condition.

Figure 3C:
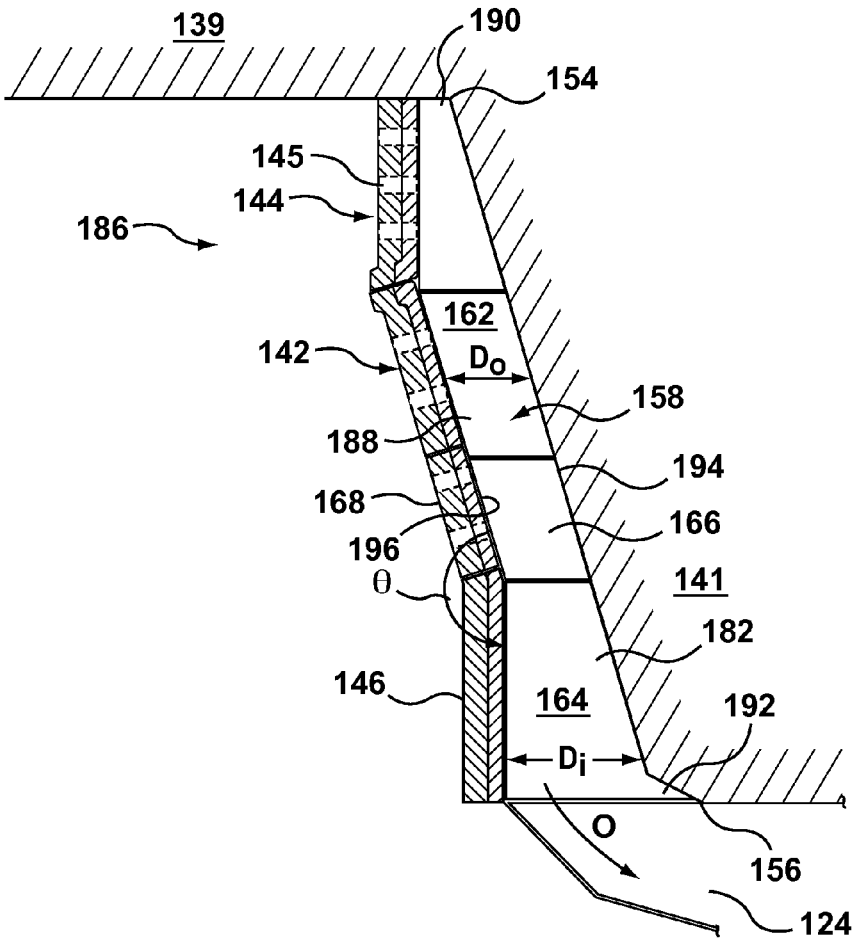
FIG. 3C is another elevation view of the pulp lifter assembly of FIG. 3A, shown in a raised condition.
Figure 4:
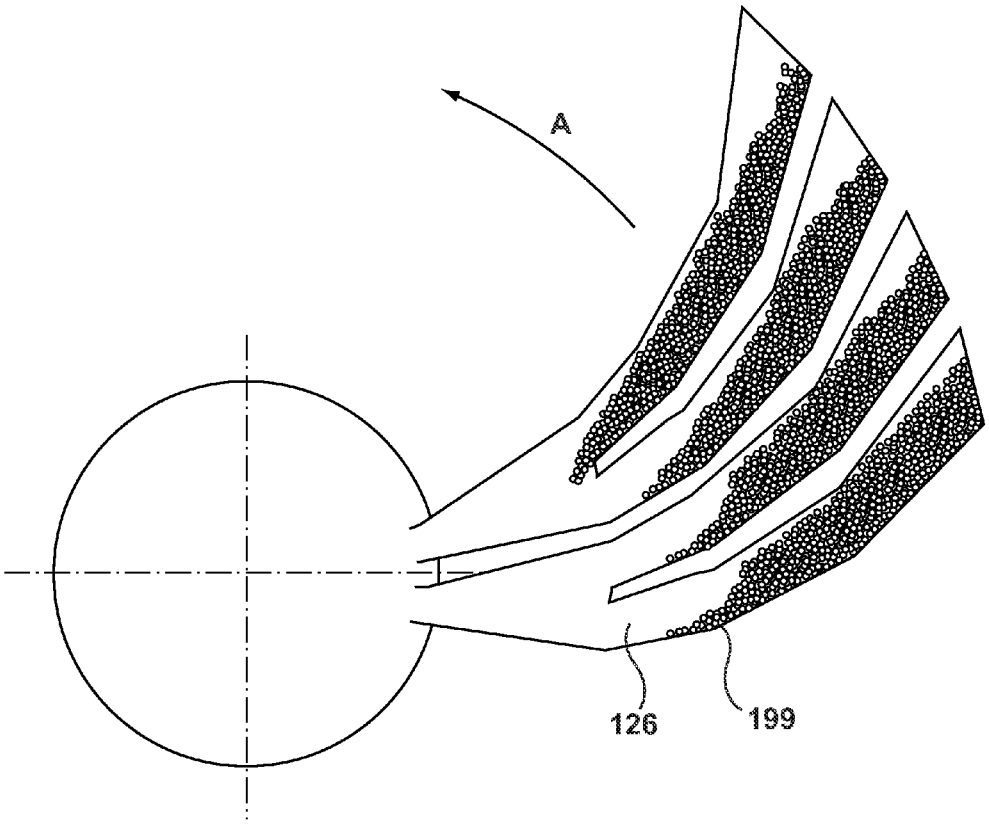
FIG. 4 is a schematic illustration of an embodiment of a discharge end liner of the invention drawn at a smaller scale, showing selected chambers positioned at approximately 3 o'clock.

Each grate subassembly 142 preferably includes one or more grate elements 144 and one or more blind plates 146 (FIGS. 3B, 3C). As can be seen in FIGS. 3B and 3C, each grate element 144 includes a number of holes 145 therein sized for screening the slurry as it flows into each chamber 126 respectively, when each chamber 126 is in the submerged condition (FIG. 3B). (It will be understood that the holes 145 are represented in FIGS. 3B and 3C as much larger than is appropriate, to simplify the illustration.) In contrast, each blind plate 146 preferably does not include holes. The blind plates 146 are located proximal to an exit port 128 through which the retained portion of the slurry exits the chamber 126. The blind plate lacks holes because its function is to at least partially direct the retained portion of the slurry toward the exit port 128.

As can be seen in FIG. 3B, each pulp lifter element 158 preferably includes a number of outer segments 138 and one or more inner segments 140. The outer portion 162 of each pulp lifter element 158 preferably includes the outer segments 138, and the inner portion 164 preferably includes the inner segment 140.

In one embodiment, the predetermined position of the part 168 of grate subassembly 142 preferably is substantially parallel to the discharge end wall 141 (FIGS. 3A-3C, 9 and 10). As can be seen, for example, in FIG. 9, the part 168 defines a substantially straight line which is parallel to the discharge end wall 141, and the blind plate 146 defines another substantially straight line which is positioned relative to the part 168 to define the obtuse angle θ, i.e., an angle between 90 and 180°. (To simplify the illustration, the holes in the grate elements 144 are not shown in FIG. 9.)

Preferably, each chamber 126 extends between the outer edge 154 of the discharge end wall 141 and the inner edge 156, and is open at the exit port 128 positioned for directing at least the retained portion of the slurry in each chamber 126 to the inner opening 124 while each chamber 126 is in the raised condition. Each exit port 128 is sized to permit the retained portion of the slurry in each chamber 126 to evacuate therefrom respectively while each chamber 126 is in the raised condition.

In one embodiment, the outer portion 162 preferably includes an outer part 170 and the intermediate part 166. As can be seen in FIGS. 3B and 3C, the outer part 170 preferably extends from the outer edge 154 toward the inner portion 164 to the intermediate part 166. In addition, the intermediate part 166 preferably is positioned between the outer part 170 and the inner portion 164 of the pulp lifter element 158. It is also preferred that the intermediate part 166 is formed to locate the part 168 of the grate subassembly 142 at least partially in the predetermined position.

In one embodiment, it is also preferred that the discharge end liner 120 additionally includes a cone element 131 for directing the retained portion of the slurry exiting each chamber 126 toward the inner opening 124.

In one embodiment, the invention includes the grinding mill 150 with the discharge end liner 120 mounted therein (FIG. 3A). As shown in FIG. 3A, the grinding mill 150 preferably includes the discharge end wall 141 and the hollow shell 152 connected to the discharge end wall 141 and rotatable in a predetermined direction about the central axis 153 thereof, for producing the slurry from the charge 151 in the shell 152. The discharge end wall 141 preferably extends between the outer edge 154 thereof connected to an outer wall 139 of the shell 152 and the inner edge 156 at least partially defining the inner opening 124 which is substantially coaxial with the central axis 153. It is also preferred that the grinding mill 150 includes the discharge end liner 120. Preferably, the discharge end liner 120 is attached to at least the discharge end wall 141.

Figure 9:
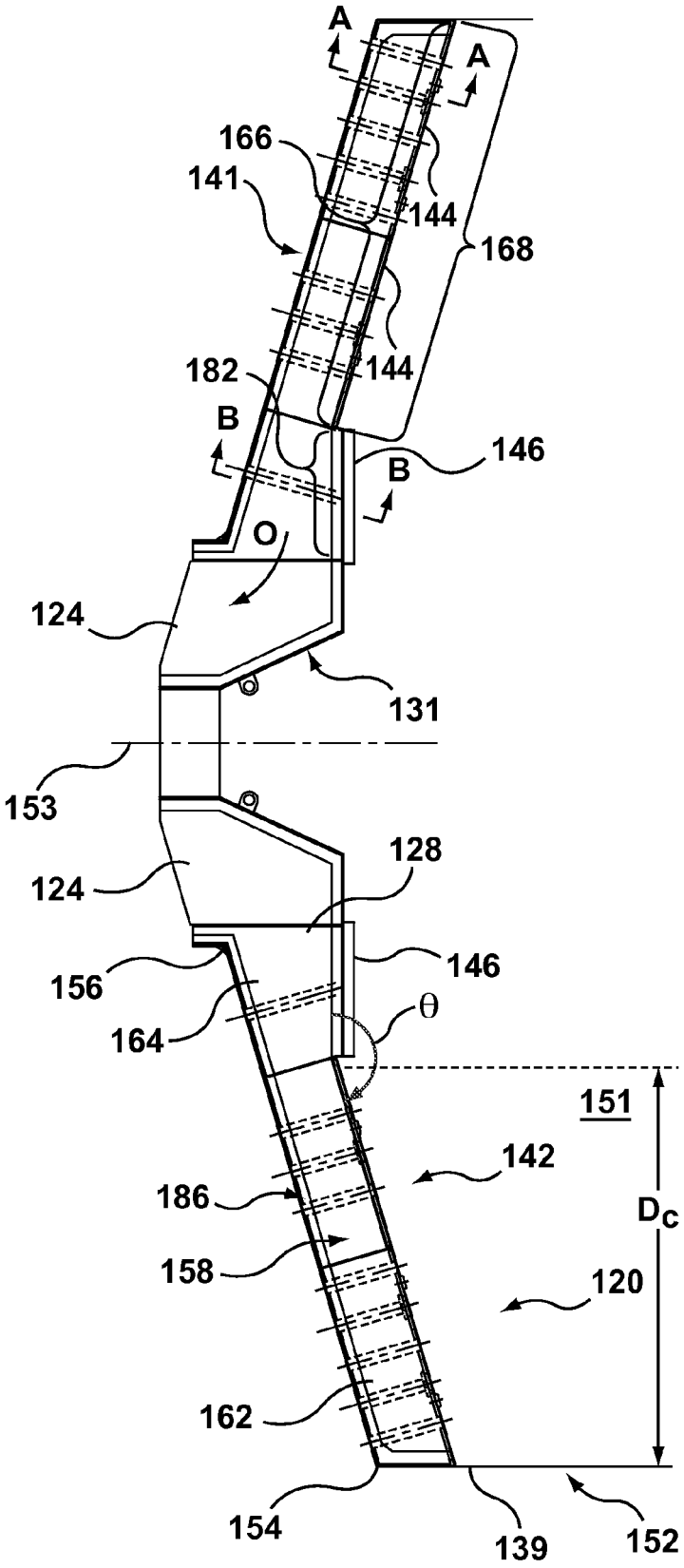
FIG. 9 is a cross-section of an embodiment of the discharge end liner of the invention, drawn at a larger scale.

As can be seen in FIGS. 3B and 3C, the discharge end liner 120 preferably includes a number of pulp lifter elements 158 mounted on the discharge end wall 141 for at least partially defining a number of chambers 126 therebetween rotatable in the predetermined direction between the submerged condition and the raised condition. In addition, the discharge end liner 120 also preferably includes one or more grate subassemblies 142 attached to the pulp lifter elements 158, for screening the slurry that flows into each chamber 126 while each chamber 126 is in the submerged condition respectively. As can be seen in FIGS. 3B and 3C, each pulp lifter element 158 includes an outer portion 162 extending from the outer edge 154 of the discharge end wall 141 towards the inner edge 156, and an inner portion 164 extending from the inner edge 156 toward the outer edge 154. At least the part 166 of the outer portion 162 locates the part 168 of the grate subassembly 142 in the predetermined position relative to the discharge end wall 141. Also, at least a part 182 of the inner portion 164 is positioned to define the obtuse angle θ between the parts 166, 182 to permit the retained portion of the slurry in each chamber 126 to evacuate therefrom respectively while each chamber 126 is in the raised condition. As can be seen in FIG. 9, the part 182 of the inner portion locates the blind plate 146 relative to the part 168 of the grate subassembly 142, i.e., to define the obtuse angle θ therebetween.

Figure 5:
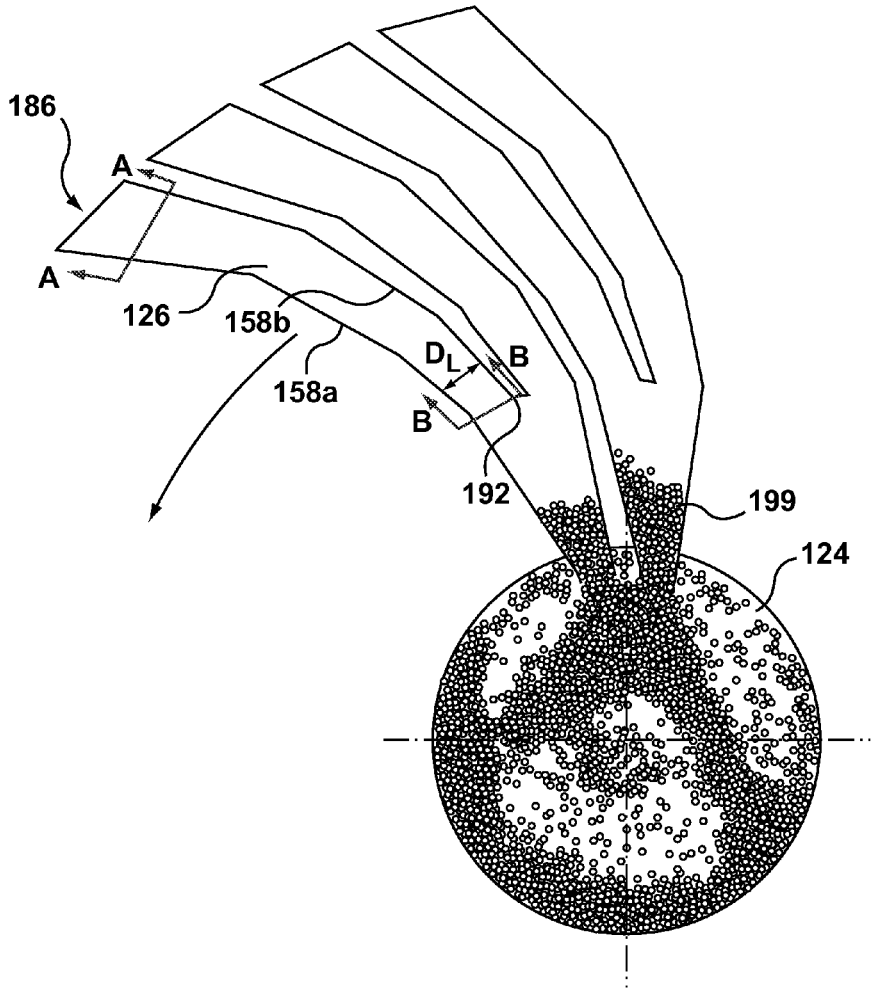
FIG. 5 is a schematic illustration of the discharge end liner of FIG. 4, showing selected chambers positioned at approximately 12 o'clock, in the raised condition.

In one embodiment, the invention includes a pulp lifter assembly 186 for attachment to the discharge end wall 141. The pulp lifter assembly 186 preferably includes two or more pulp lifter elements 158. Two pulp lifter elements 158 of the pulp lifter assembly 186 are identified, for purposes of illustration, in FIG. 5 as elements 158*a* and 158*b*. Each pulp lifter element 158 includes an elongate body 188 (FIG. 3C) attachable to the discharge end wall 141 and extending between an outer end 190 thereof positionable proximal to the outer edge 154 of the discharge end wall 141 and an inner end 192 proximal to the inner edge 156. As can be seen in FIG. 5, the pulp lifter elements 158*a*, 158*b* include a leading element (e.g., 158*a* in FIG. 5) and a trailing element (e.g., 158*b* in FIG. 5). The leading element precedes the trailing element as the pulp lifter elements are rotated in the predetermined direction. The pulp lifter body 188 includes the outer portion 162, extending from the outer end 190 thereof toward the inner end 192, and the inner portion 164, extending from the inner end 192 toward the outer end 190.

Preferably, the elongate body 188 includes an interior edge 194 extending between the inner and outer ends 192, 190 and positionable proximal to the discharge end wall 141, and an exterior edge 196 spaced apart from the interior edge 194 by at least one inner depth dimension "D," in the inner portion 164, and by at least one outer depth dimension "$D_o$" in the outer portion 162. The exterior edge 196 preferably extends between the inner and outer ends 192, 190. In addition, the pulp lifter elements 158 are spaced apart from each other by at least one predetermined lateral distance "$D_L$". The pulp lifter assembly 186 preferably also includes one or more grate subassemblies 142 attachable to the exterior edges 196 of the pulp lifter elements 158, to at least partially define the chamber 126 therebetween and the exit port 128 positioned at the inner end 192 of at least one of the two pulp lifter elements 158, as will be described.

As described above, each grate subassembly 142 also preferably includes one or more blind plates 146. Each grate element 144 includes a number of holes 145 sized for screening the slurry as the slurry flows into each chamber 126 respectively, when the pulp lifter assembly is in the submerged condition. The trailing element preferably is formed to lift at least the retained portion of the slurry in the chamber as the pulp lifter elements are rotated to the raised condition, and to direct the retained portion of the slurry to the exit port when in the raised condition. Preferably, the inner depth dimension exceeds the outer depth dimension to define the exit port, for permitting the retained portion of the slurry in the chamber to evacuate therefrom under the influence of gravity while the two pulp lifter elements are in the raised condition.

The body 188 preferably includes the segments 138, 140. As shown in FIGS. 3B and 3C, the exterior edge 196 of the outermost pulp lifter segment (identified as 138*a* in FIG. 3B) diverges from the exterior edge 196 of the segments 138 forming the intermediate part 166 (FIG. 3B). In particular, while the exterior edge 196 of the intermediate part 166 is substantially parallel to the discharge end wall 141, the exterior edge 196*a* (FIG. 3B) of the outermost pulp lifter segment 138*a* is angled toward the discharge end wall 141. The advantage of this arrangement is that it permits a longer effective grinding length in the shell 152 at diameters proximal to the outer wall 139. The disadvantage of this configuration, namely, a somewhat smaller cross-sectional area of the chamber 126 in the portion thereof partially defined by the outermost pulp lifter segment 138*a*, is thought to be more than offset by the advantage of the longer effective grinding length.

Preferably, each grate subassembly 142 includes one or more blind plates 146, for at least partially directing the retained portion of the slurry toward the exit port 128. The blind plate 146 preferably is positioned relative to the grate elements 144 to define an obtuse angle between the blind plate 146 and one or more of the grate elements 144.

Preferably, the chamber has at least one outer cross-sectional area "$A_o$" (FIG. 8A) which is at least partially defined by the outer depth dimension and the grate. The exit port 128 preferably has an exit port cross-sectional area "$A_e$" (FIG. 8B) which is at least partially defined by the inner depth dimension and the grate. The exit port cross-sectional area preferably is greater than the inner cross-sectional area, to permit movement of the retained portion of the slurry out of the chamber due to gravity.

In one embodiment, the discharge end liner 120 includes a number of the pulp lifter assemblies 186 and the cone 131 positioned to direct the retained portion of the slurry exiting each chamber 126 via the exit port 128 toward the inner opening 124.

INDUSTRIAL APPLICABILITY

In use, and as can be seen in FIGS. 4-7, the shell and the discharge end liner 120 are rotated in the predetermined direction indicated by arrow "A" in FIGS. 4-7. When the chamber 126 is in approximately the 3 o'clock position, particles 199 positioned therein are beginning to flow out of the chamber, but have not begun to exit therefrom.

In FIG. 5, the chamber 126 and chambers proximal thereto are shown in approximately the 12 o'clock position and further. In this position, almost all of the particles 199 which had been in the chamber have been discharged into the inner opening 124.

Figure 6:
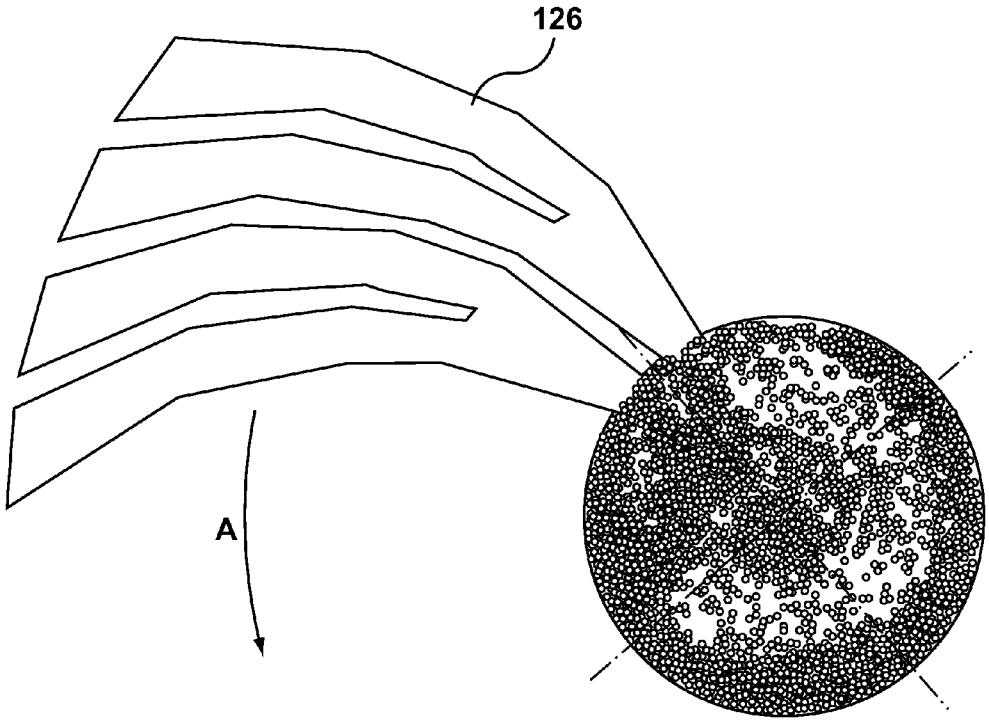
FIG. 6 is a schematic illustration of the discharge end liner of FIG. 4 showing selected chambers positioned at approximately 9 o'clock, in the raised condition.

In FIG. 6, the chambers which are shown are approximately at the 9 o'clock position, and at this point, all the particles have been discharged from the chambers in question.

Figure 7:
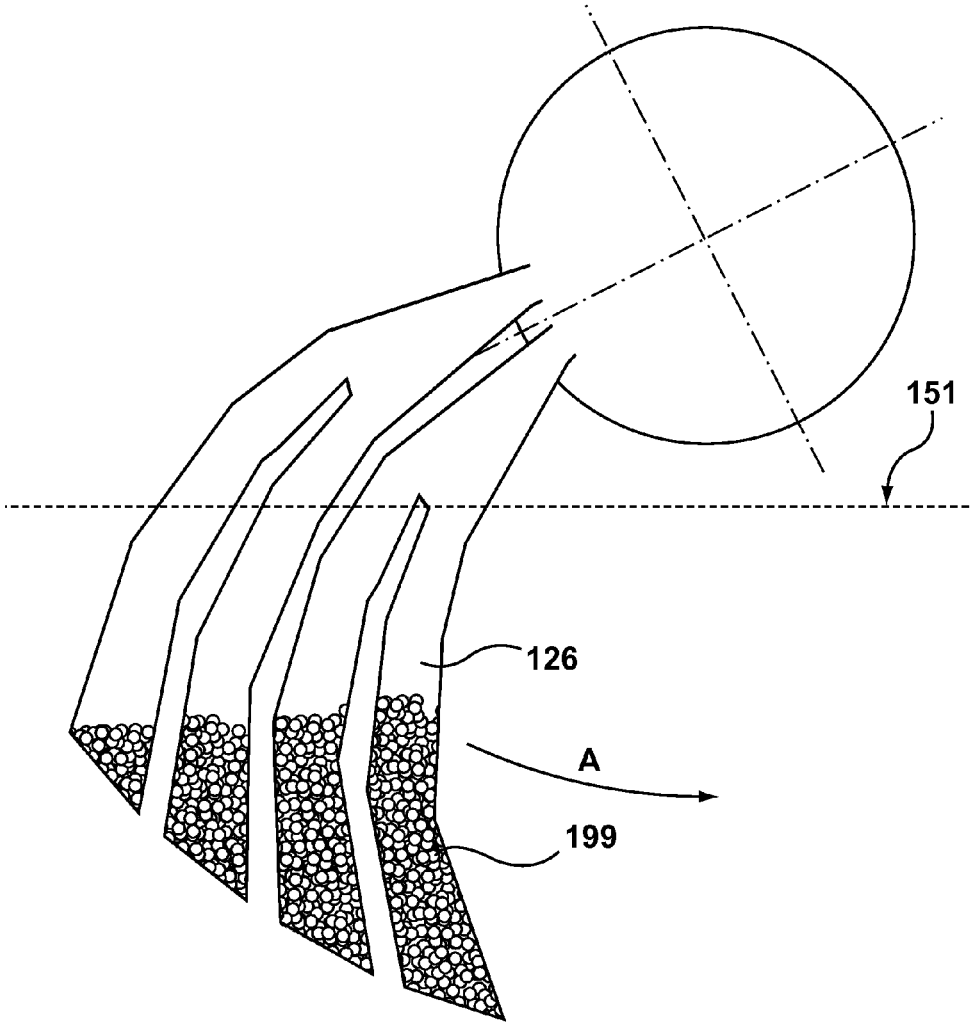
FIG. 7 is a schematic illustration of the discharge end liner of FIG. 4 showing selected chambers positioned in the submerged condition (i.e., at least partially submerged)
Figure 8A:
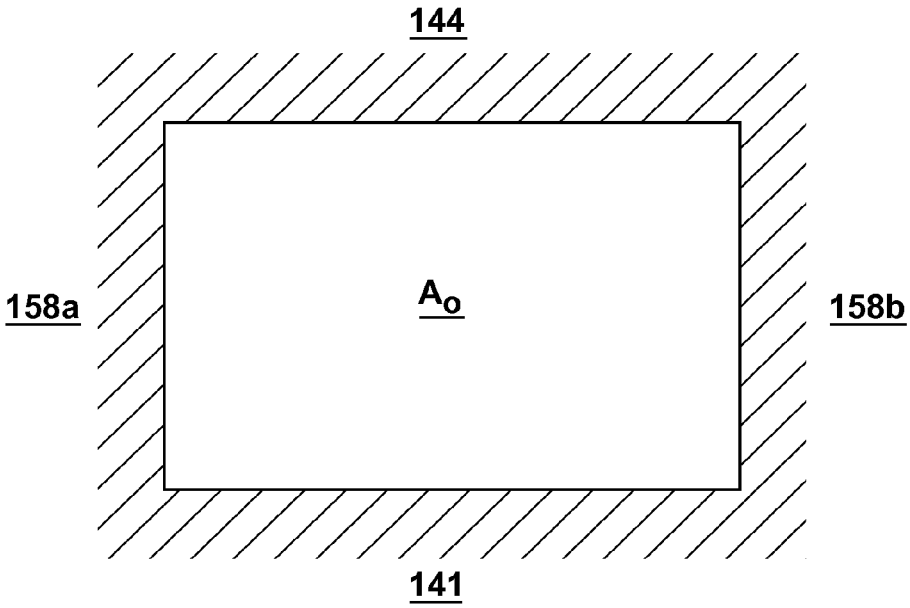
FIG. 8A is a cross-section of an embodiment of the pulp lifter assembly of the invention taken at A-A in FIG. 5.
Figure 8B:
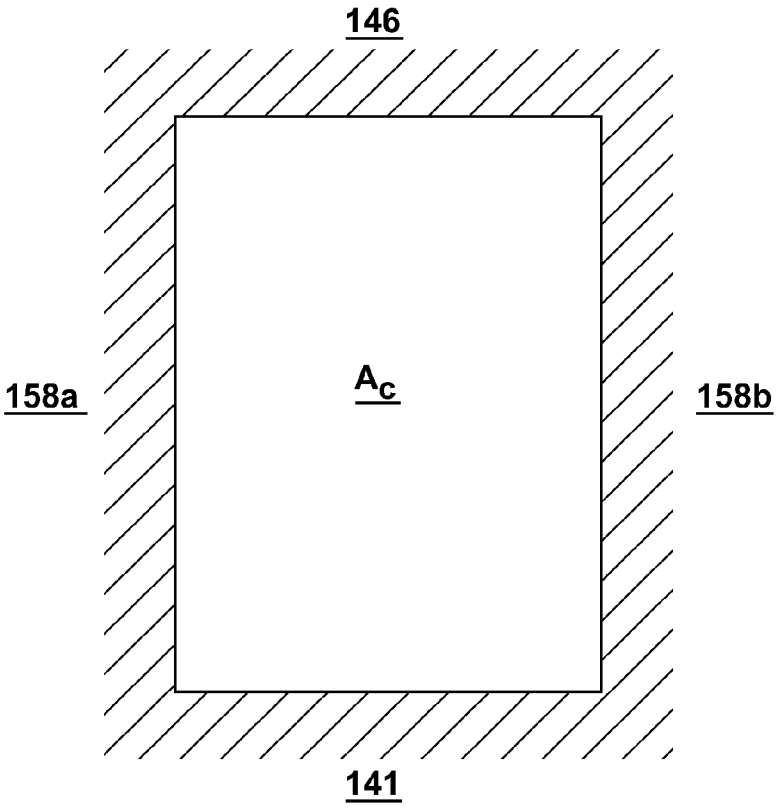
FIG. 8B is a cross-section of an embodiment of a pulp lifter assembly of the invention taken at B-B in FIG. 5.

In FIG. 7, the chambers which are shown are in the submerged condition. Particles 199 have begun to enter into the chambers, i.e., due to inflow from the charge.

It will be understood that, to simplify the illustration, only certain chambers are shown in FIGS. 4-7. FIGS. 4-7 are based on a computer model simulation, and FIGS. 4-7 demonstrate that the invention herein succeeds in achieving the flow required in order to substantially evacuate a particular chamber before it reaches the 9 o'clock position.

It will be appreciated by those skilled in the art that in the grinding mill 150 of the invention, the blind plate 146 extends into the cavity defined by the shell further than the grate elements 144 (FIG. 3A). However, as the charge typically is positioned below the blind plate (as shown, e.g., in FIG. 3B), this positioning of the blind plate 146 does not adversely affect the effective grinding length of the mill. Accordingly, the invention provides the benefit of permitting evacuation of each chamber as the mill is rotating at a relatively high operational speed, while each chamber is in the raised condition.

Figure 10:
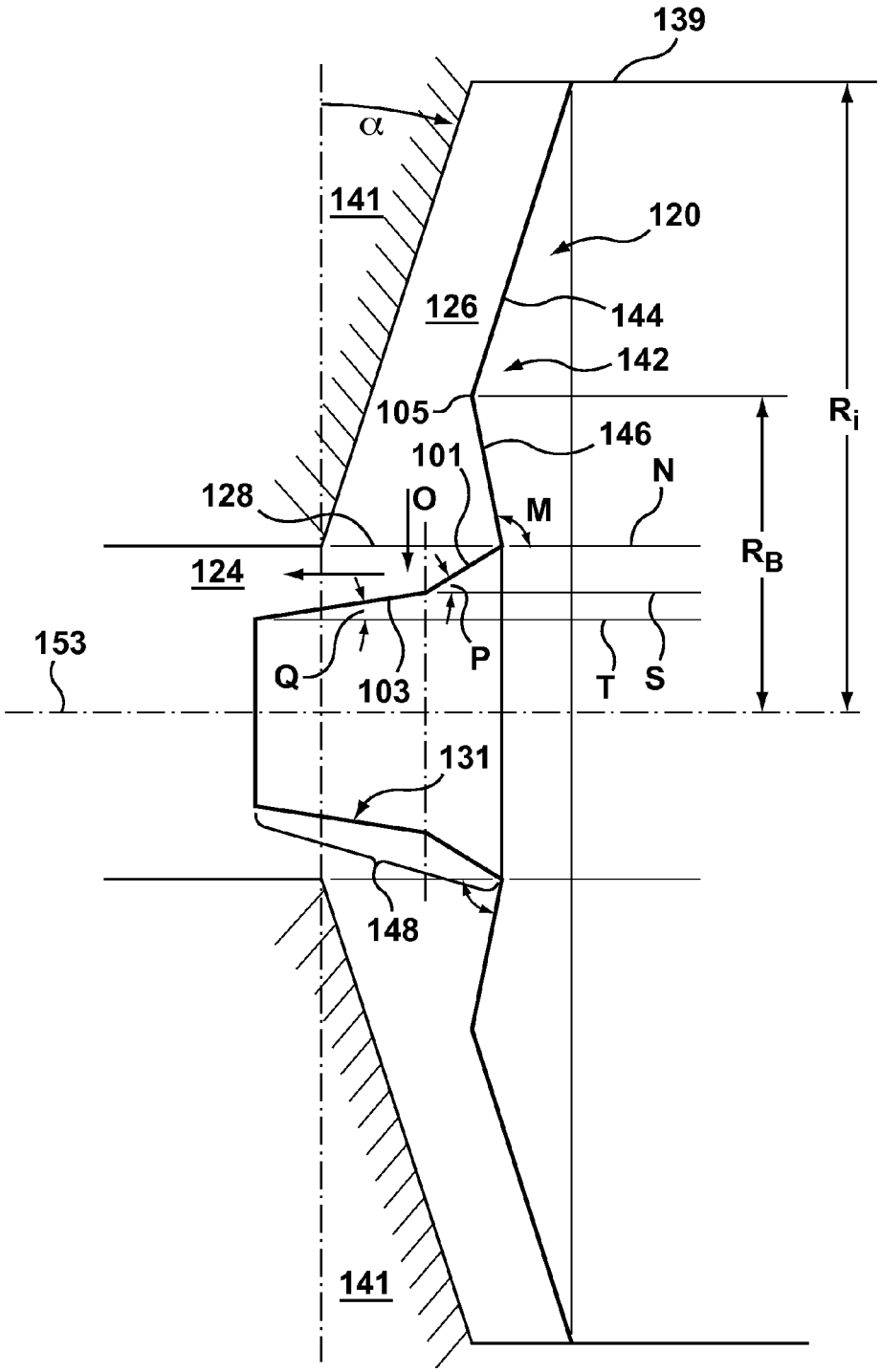
FIG. 10 is a schematic illustration of the cross-section of the discharge end liner of FIG. 9.

The discharge end liner 120 of the invention is schematically illustrated in FIG. 10. Typically, mill heads are constructed at various positions relative to the vertical, for various reasons. As an example, the mill head 141 is positioned at an angle $\alpha$ from the vertical. For example, the mill head 141 is positioned at approximately 18.5° from the vertical. It will be appreciated by those skilled in the art that the mill head may be positioned up to 30° from the vertical. As can be seen in FIG. 10, the angle "M" is between the blind plate 146 and an imaginary line "N" parallel to the central axis 153. Preferably, the angle "M" is between approximately 75° at approximately 105° depending, at least to an extent, on the angle of the mill head 141 relative to the vertical.

As described above, the grate subassembly 142 is supported (and spaced apart from the discharge end wall 141) by the pulp lifter element 158 (not shown in FIG. 10). As shown in FIG. 10, flow of the retained portion of the slurry out of the chamber 126 (i.e., in the direction indicated by the arrow "O") is facilitated by the positioning of the blind plate 146 relative to the grate elements 144, i.e., to provide a relatively large exit port.

Slurry exiting the chamber 126 through the exit port 128 is directed to the inner opening 124 by the cone 131. For instance, where the mill head 141 is positioned at 30° from the vertical, the angle "M" may be up to approximately 105°.

However, where the mill head is inclined less relative to the vertical, the maximum of angle "M" is approximately 90°. Although a number of factors preferably are considered and balanced in designing a pulp lifter for a particular application, it appears that the preferred maximum of angle "M" depends, in part, on the extent to which the larger exit port 128 is needed for complete evacuation of the retained portion of the slurry out of the chamber 126 while the chamber 126 is in the raised condition.

As can be seen in FIG. 10, the cone 131 includes the outer wall 148 which may be curved or, as shown in FIG. 10, may include substantially straight wall segments 101, 103. As can be seen in FIG. 10, the cone 131 differs from cones in the prior art in that the outer wall 148 extends into the cavity of the shell to direct slurry exiting the chamber 126 toward the inner opening 124. The angle "P" (defined by the wall segment 101 and an imaginary line "S" parallel to the central axis 153) may advantageously vary between approximately 30° and approximately 75°. The angle "Q" (defined by the wall segment 103 and an imaginary line "T" parallel to the central axis 153) may advantageously vary between approximately 0° and approximately 45°.

The distance between the central axis 153 and an outer edge 105 of the blind plate 146 is designated in FIG. 10 as "$R_B$". $R_B$ may vary between approximately 10 percent of the mill's inner radius and approximately 66 percent of the mill's inner radius "$R_i$".

The manner in which the pulp lifters are attached to the discharge end wall is well known in the art, and it is not necessary to describe such attachment means in detail. Similarly, the manner in which the grate subassembly is attached to the pulp lifters in well known in the art. To simplify the illustration, pulp lifter elements are not shown in FIG. 10.)

Figure 11:
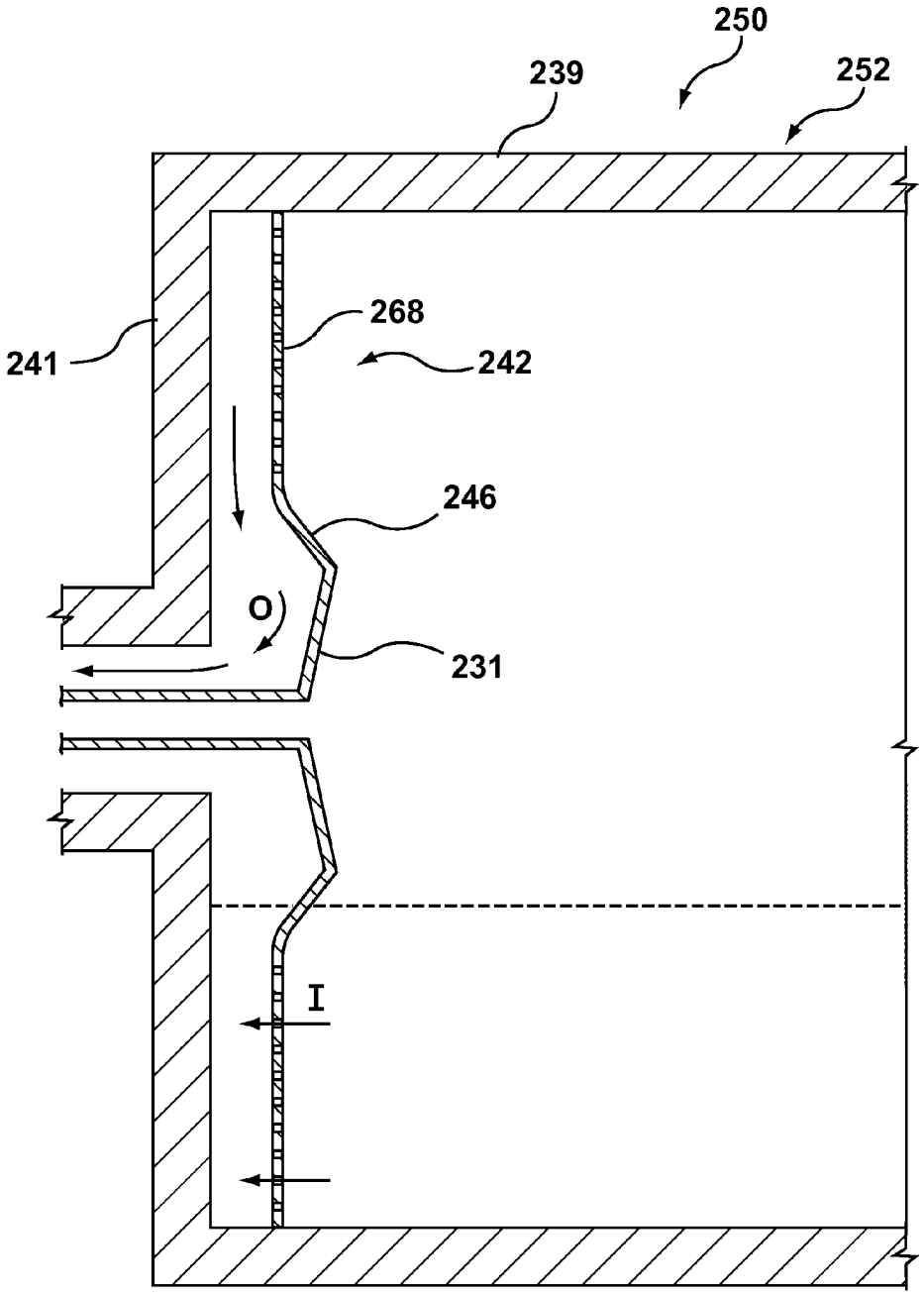
FIG. 11 is a cross-section of an alternate embodiment of the discharge end liner of the invention.

An alternative embodiment of the invention is shown in FIG. 11. In FIG. 11, elements are numbered so as to correspond to like elements shown in FIGS. 3A-10.

As can be seen in FIG. 11, in another embodiment of the grinding mill 250 of the invention, the discharge end wall 241 is substantially orthogonal to the outer wall 239 of the shell 252. Accordingly, the predetermined position of the part 268 of the grate subassembly 242 is substantially orthogonal to the outer wall 239, as well as substantially parallel to the discharge end wall 241. The blind plate 246 is positioned to define the obtuse angle between the part 268 of the grate subassembly 242 and the blind plate 246.

It will be appreciated by those skilled in the art that the invention can take many forms, and that such forms are within the scope of the invention as claimed. Therefore, the spirit and scope of the appended claims should not be limited to the descriptions of the preferred versions contained herein.

We claim:

1. A discharge end liner attachable to a discharge end wall in a grinding mill, the grinding mill including a hollow shell connected to the discharge end wall and rotatable in a predetermined direction about a central axis thereof to produce a slurry including liquid and particles from a charge in the shell, the discharge end wall extending between an outer edge thereof connected to the shell and an inner edge at least partially defining an inner opening substantially coaxial with the central axis, the discharge end liner comprising:

a plurality of pulp lifter elements mountable on the discharge end wall for at least partially defining a plurality of chambers rotatable in the predetermined direction between a submerged condition, in which each said chamber is at least partially submerged in the charge to permit the slurry to enter each said chamber respectively, and a raised condition, in which at least a retained portion of the slurry in each said chamber is drainable into the inner opening;

at least one grate subassembly positionable on the pulp lifter elements, for at least partially screening the slurry as it flows into each said chamber respectively while each said chamber is in the submerged condition;

each said pulp lifter element comprising an outer portion extending from the outer edge of the discharge end wall toward the inner edge, and an inner portion extending from the inner edge toward the outer edge, when each said pulp lifter element is attached to the discharge end wall;

at least part of the outer portion being formed to locate at least a part of said at least one grate subassembly in a predetermined position relative to the discharge end wall; and the inner portion being formed to define an obtuse angle between the outer and inner portions of each said pulp lifter element to permit said retained portion of the slurry in each said chamber respectively to evacuate therefrom respectively while each said chamber is in the raised condition.

2. A discharge end liner according to claim 1 in which the predetermined position of said part of said at least one grate subassembly is substantially parallel to the discharge end wall.

3. A discharge end liner according to claim 1 in which the predetermined position of said part of said at least one grate subassembly is substantially orthogonal to the outer wall of the shell.

4. A discharge end liner according to claim 1 in which:

each said chamber extends between the outer edge of the discharge end wall and the inner edge, and is open at an exit port positioned for directing at least said retained portion of the slurry in each said chamber to the inner opening while each said chamber is in the raised condition; and each said exit port is sized to permit said retained portion of the slurry in each said chamber to evacuate therefrom respectively while each said chamber is in the raised condition.

5. A discharge end liner according to claim 1 in which:

the outer portion comprises an outer part and an intermediate part;

the outer part extends from the outer edge toward the inner portion to the intermediate part, and the intermediate part is positioned between the outer part and the inner portion of the pulp lifter element; and the intermediate part is formed to locate said part of said at least one grate subassembly in the predetermined position.

6. A discharge end liner according to claim 1 additionally comprising a cone element for directing said retained portion of the slurry exiting each said chamber respectively toward the inner opening.

7. A grinding mill for producing a slurry comprising liquid and particles from a charge, the grinding mill comprising:

a discharge end wall;

a hollow shell connected to the discharge end wall and rotatable in a predetermined direction about a central axis thereof, for producing the slurry from the charge in the shell;

the discharge end wall extending between an outer edge thereof connected to an outer wall of the shell and an inner edge at least partially defining an inner opening substantially coaxial with the central axis;

a discharge end liner attached to at least the discharge end wall, the discharge end liner comprising:

a plurality of pulp lifter elements mounted on the discharge end wall, for at least partially defining a plurality of chambers therebetween rotatable in the predetermined direction between a submerged condition, in which each said chamber is at least partially submerged in the charge to permit the slurry to enter each said chamber respectively, and a raised condition, in which at least a portion of the slurry in each said chamber is drainable into the inner opening;

at least one grate subassembly attached to the pulp lifter elements, for screening the slurry as it flows into each said chamber respectively while each said chamber is in the submerged condition;

each said pulp lifter element comprising an outer portion extending from the outer edge of the discharge end wall toward the inner edge and an inner portion extending from the inner edge toward the outer edge;

at least a part of the outer portion locating at least a part of said at least one grate subassembly in a predetermined position relative to the discharge end wall; and at least a part of the inner portion being positioned to define an obtuse angle between the part of the inner portion and the part of the outer portion to permit said retained portion of the slurry in each said chamber to evacuate therefrom respectively while each said chamber is in the raised condition.

8. A pulp lifter assembly for attachment to a discharge end wall in a grinding mill, the grinding mill including a hollow shell rotatable in a predetermined direction about a central axis thereof for producing a slurry including liquid and particles from a charge in the shell, the discharge end wall extending between an outer edge thereof connected to the shell and an inner edge at least partially defining an inner opening substantially coaxial with the central axis, the pulp lifter assembly, when attached to the discharge end wall, being rotatable in the predetermined direction between a submerged condition, in which a plurality of chambers are at least partially submerged in the charge, and a raised condition, in which the chambers are positioned above the charge, the pulp lifter assembly comprising:

at least two pulp lifter elements, each said pulp lifter element comprising an elongate body attachable to the discharge end wall and extending between an outer end positionable proximal to the outer edge of the discharge end wall and an inner end positionable proximal to the inner edge;

said at least two pulp lifter elements comprising a leading element and a trailing element, the leading element preceding the trailing element as the pulp lifter elements rotate in the predetermined direction;

the body comprising an outer portion extending from the outer end toward the inner end and an inner portion extending from the inner end toward the outer end;

the body additionally comprising:

an interior edge extending between the inner and outer ends and positionable proximal to the discharge end wall;

an exterior edge spaced apart from the interior edge by at least one inner depth dimension in the inner portion, and by at least one outer depth dimension in the outer portion, the exterior edge extending between the inner and outer ends;

said at least two pulp lifter elements being spaced apart from each other by at least one predetermined lateral distance;

at least one grate subassembly attachable to the exterior edges of said at least two pulp lifter elements to at least partially define a chamber therebetween and an exit port positioned at the inner end of at least one of said at least two pulp lifter elements;

said at least one grate subassembly comprising at least one grate element comprising a plurality of holes sized to screen the slurry as it flows into each said chamber respectively when said pulp lifter assembly is at least partially in the submerged condition;

the trailing element being formed to lift at least a portion of the slurry in the chamber as said at least two pulp lifter elements are rotated to the raised condition, and to direct said portion to the exit port when in the raised condition; and said at least one inner depth dimension exceeding said at least one outer depth dimension to define the exit port, to permit said portion of the slurry in the chamber to evacuate therefrom under the influence of gravity while said at least two pulp lifter elements are in the raised condition.

9. A pulp lifter assembly according to claim 8 in which:

said at least one grate subassembly additionally comprises at least one blind plate, for at least partially directing said retained portion of the slurry toward the exit port; and said at least one blind plate is positioned to define an obtuse angle between said at least one blind plate and said at least one grate element.

10. A pulp lifter assembly according to claim 8 in which:

the chamber has at least one outer cross-sectional area at least partially defined by said at least one outer depth dimension and the grate;

the exit port has an exit port cross-sectional area at least partially defined by said at least one inner depth dimension and the grate; and the exit port cross-sectional area is greater than said at least one inner cross-sectional area, to permit movement of said portion of the slurry out of the chamber due to gravity.

11. A discharge end liner attachable to a discharge end wall in a grinding mill, the grinding mill including a hollow shell connected to the discharge end wall and rotatable in a predetermined direction about a central axis thereof to produce a slurry including liquid and particles from a charge in the shell, the discharge end wall extending between an outer edge thereof connected to the shell and an inner edge at least partially defining an inner opening substantially coaxial with the central axis, the discharge end liner comprising:

a plurality of pulp lifter assemblies according to claim 8; and a cone positioned to direct said portion of the slurry exiting each said chamber via the exit port toward the inner opening.

* * * * *